United States Patent [19]

Wünsche

[11] Patent Number: 4,876,998

[45] Date of Patent: Oct. 31, 1989

[54] CRANKCASE FOR INTERNAL COMBUSTION ENGINES

[75] Inventor: Peter Wünsche, Graz, Austria

[73] Assignee: 501 AVL Gesellschaft fur Verbrennungskraftmaschinen und Messtechnik MbH, Graz, Austria

[21] Appl. No.: 245,829

[22] Filed: Sep. 19, 1988

[30] Foreign Application Priority Data

Sep. 22, 1987 [AT] Austria ..... 2404/87

[51] Int. Cl.[4] ..... F02B 77/00

[52] U.S. Cl. ..... 123/198 E; 123/195 R; 123/195 H

[58] Field of Search ..... 123/195 R, 195 H, 198 E; 92/261

[56] References Cited

U.S. PATENT DOCUMENTS 1,836,189 12/1931 Salisbury ..... 123/195 R
4,213,440 7/1980 Abe et al. ..... 123/198 E
4,771,747 9/1988 Ballheimer et al. ..... 123/195 H

*Primary Examiner*—Noah P. Kamen
*Attorney, Agent, or Firm*—Watson, Cole, Grindle & Watson

[57] ABSTRACT

The oilpan of a low-noise crankcase is bolted to the downwardly extending crankcase sidewalls and has omega-shaped crosspieces extending transversely to the oilpan sidewalls and to the sidewalls of the crankcase, and the crosspieces are in alignment with the main bearing walls of the crankcase. The crosspieces form part of the oilpan and are connected to its sidewalls in such a manner that forces are propagated, the sidewalls being reinforced as compared to the bottom of the oilpan which is not reinforced. The oilpan is bolted to the crankcase by additional bolts located in pockets in the crosspieces on both sides of the cylinder axes, and are attached to the crankcase as far away from the outer walls thereof as possible.

5 Claims, 3 Drawing Sheets

CRANKCASE FOR INTERNAL COMBUSTION ENGINES

BACKGROUND OF THE INVENTION

This invention relates to a crankcase for internal combustion engines having main bearing walls comprising main bearing seats and main lower bearing caps, and sidewalls extending downwardly below the main bearing caps, and having an oilpan the sidewalls of which are connected by crosspieces forming a continuation of the main bearing walls.

DESCRIPTION OF THE PRIOR ART

German Pat. No. 35 20 176 discloses an internal combustion engine in which the oilpan is provided with a flange configured as a rigid frame with a U-shaped cross-section opening towards the top. A rigid crankcase is formed having a high characteristic frequency which reduces noise in internal combustion engines.

Such an oilpan arrangement improves the flexural rigidity of the crankcase to a certain extent, whereas torsional rigidity remains unstatisfactory. For this reason noise radiation is comparatively high in this known type of combustion engine. Another disadvantage is that the frame with its cross-section opening towards the top must have openings for the oil drain, which will reduce rigidity.

SUMMARY OF THE INVENTION

It is an object of the present invention to drastically reduce the noise radation of the internal combustion engine, in an economical manner, without increasing th outer dimensions of the engine.

This is effected according to the invention by providing the crosspieces with an omega-shaped cross-section opening towards the bottom, and by configuring the crosspieces as elements integrally cast with the oilpan and thus attached to its sidewalls so as to be torsionally rigid. Additional bolts are provided for fastening the oilpan to the crankcase in addition to the bolts provided on the sidewalls of the crankcase, the additional bolts being located in pockets in the crosspieces which are disposed as far away from the outer walls as possible.

By connecting the downwardly extending sidewalls of the crankcase in a torsionally rigid manner the propagation of deformations due to gas or mass forces from the main bearing seats to the outer structure is largely prevented, thus ensuring a low-noise crankcase.

In a further development of the invention the bottom representing the boundary of the sidewalls in the separating plane between the crankcase and the oilpan, may include pockets located side by side in the main bearing walls for receiving the fastening bolts, which pockets may be supported against the corresponding side-wall, or the main bearing seat, by means of ribs. In such manner the bearing seats are largely buttressed by the torsionally rigid oilpan, and the sidewalls of the crankcase are maintained free from forces.

According to the invention it is advantageous for the main bearing seats to be additionally supported on the sidewalls of the crankcase by ribs extending orthogonal to the cylinder axes, and the vertical distance between the area at which the ribs extend from the pockets and meet the sidewall of the crankcase, and from there to the area at which the perpendicular ribs meet the sidewalls of the crankcase, is about the same.

It is particularly effective for the ribs extending from the outer pockets to be separated from the main bearing seats by recesses of suitable depth extending above the horizontal plane containing the axis of the crankshaft. Deformations due to gas and mass forces from propogating toward the sidewall of the crankcase are therefore avoided, and noise radiation from the sidewalls is thereby minimised.

DETAILED DESCRIPTION OF THE INVENTION

Figure 1:
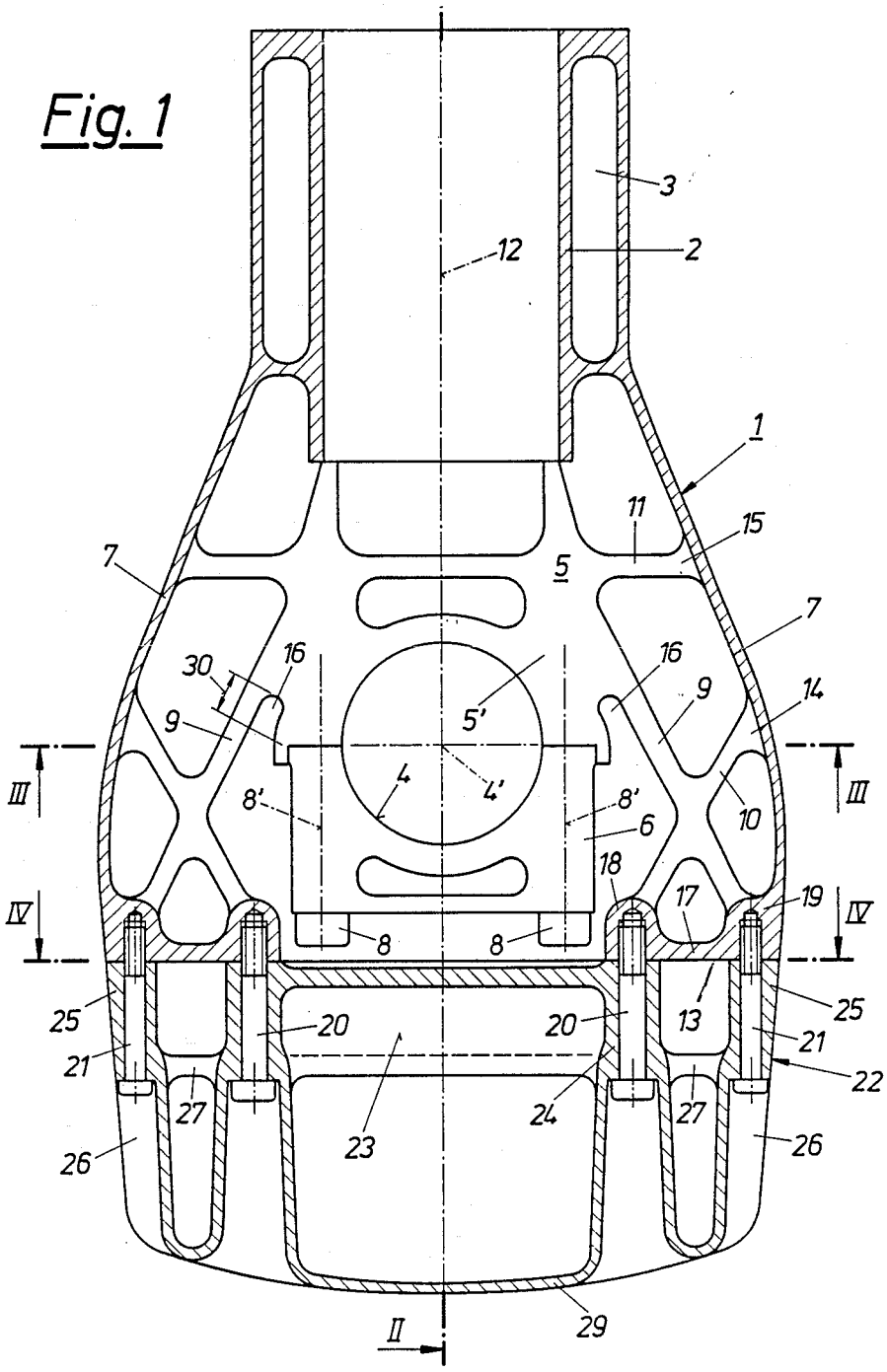
FIG. 1 is a vertical section of a crankcase according to the invention, taken along the line I—I of FIG. 2.
Figure 2:
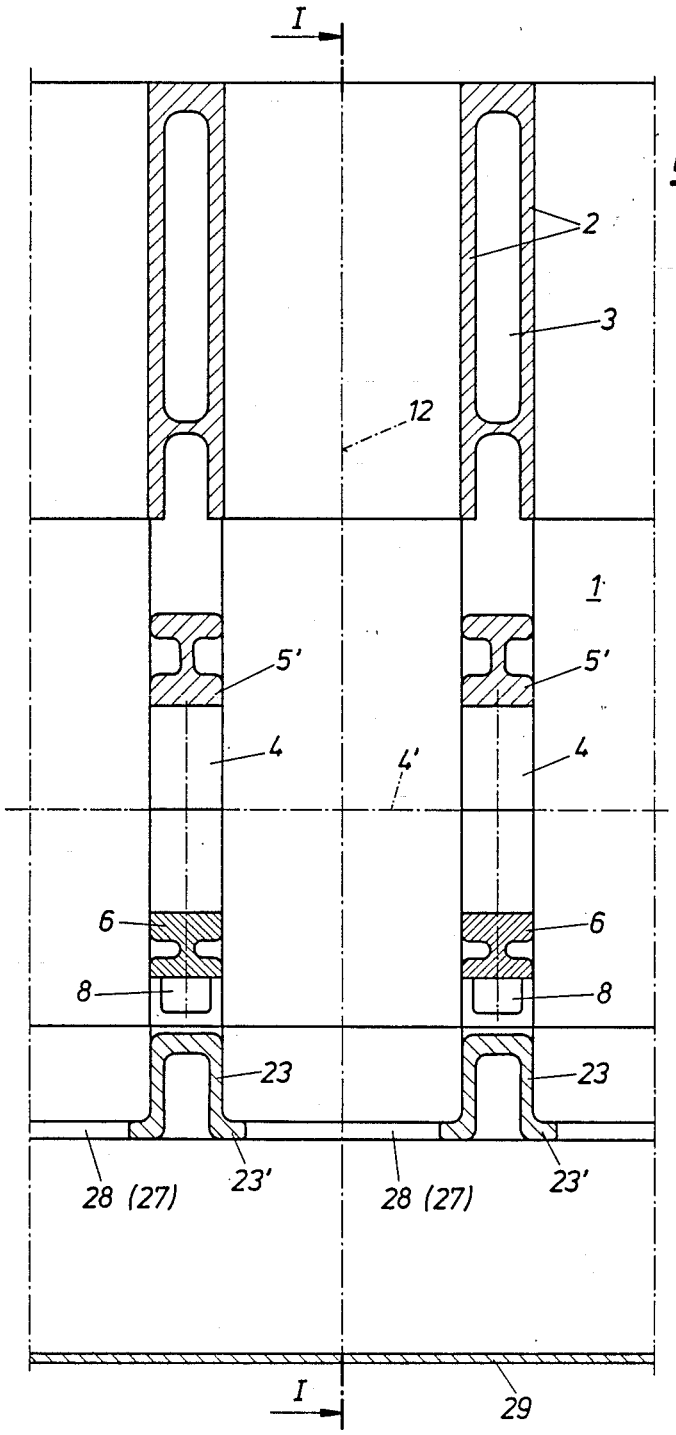
FIG. 2 is a section taken along the line II—II of FIG. 1.
Figure 3:
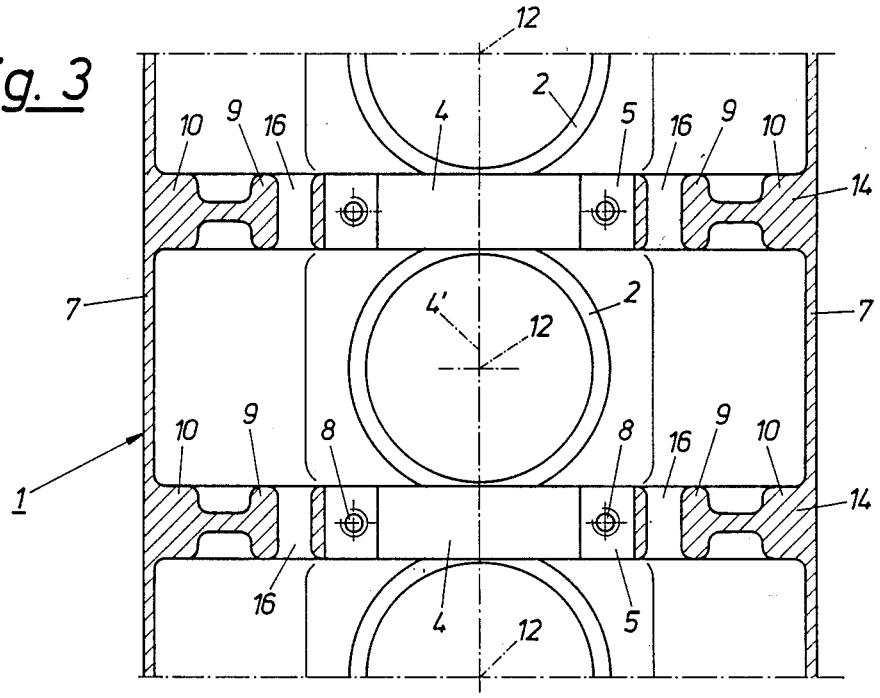
FIG. 3 is a section taken along the line III—III of FIG. 1.
Figure 4:
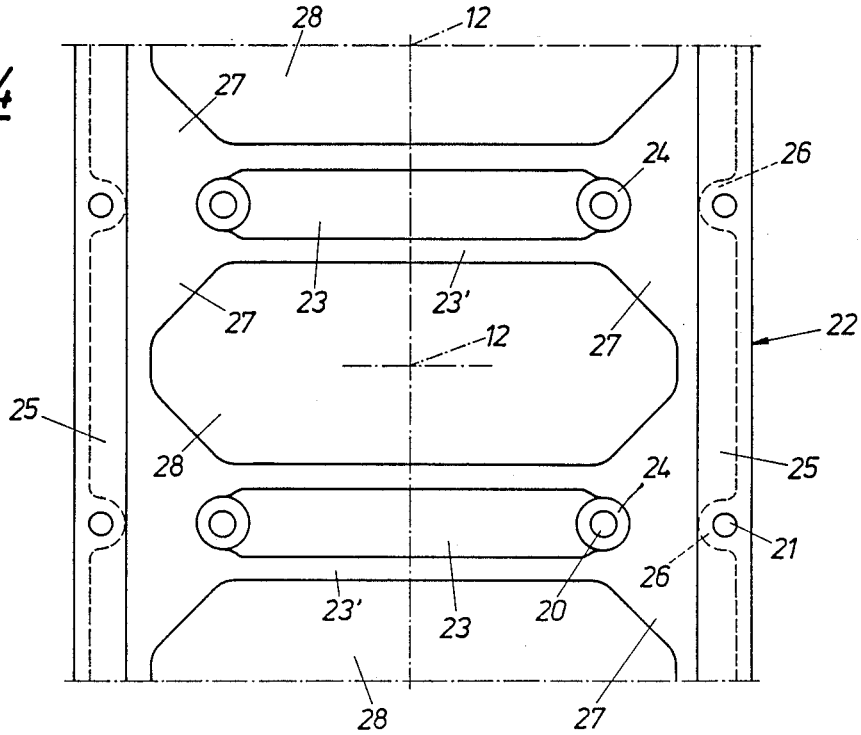
FIG. 4 is a view taken along the line IV—IV of FIG. 1.

The crankcase 1 of a multi-cylinder internal combustion engine of the in-line type comprises a cylinder part 2 and a water jacket 3 as well as main bearing walls 5, all cast in one piece, the walls 5 containing main bearings 4 of the crankshaft (not shown) having a central axis 4'. The crankshaft main bearings 4 include main bearing seats 5' forming part of the main bearing walls 5, and further include main bearing caps 6.

The main bearing caps 6 are fastened to the main bearing seats 5' by bolts 8 having central axes shown at 8'. The main bearing seats 5' are connected to sidewalls 7 of the crankcase by intersecting first ribs 9 and 10 as well as second ribs 11 extending orthogonal to cylinder axis 12 and to the central axis 4. The first ribs 9 and 10 extend from a first area of separating plane 13, ribs 10 meeting the sidewalls 7 in a second area 14, ribs 11 meeting sidewalls 7 in a third area 15, and the vertical distance between areas 14 and 15 being the same as that between area 14 and the separating plane 13. The main bering seats 5' are separated from the ribs 9 by recesses 16 which are located above the bearing caps and on either side of the central axis 4', thereby preventing deformations due to gas and mass forces from propagating toward the side-wall 7 of the crankcase. The suitable depth 30 of the recesses 16 is obtained by practical experiments and calculations.

The ribs 9 and 10 terminate in bottom sections 17 which serve as lower boundaries of the sidewalls 7 of the crankcase 1 and which extend downwardly below the main bearing caps 6. Bottom sections 17 have pockets 18 and 19 for the reception of second bolts 20 and first bolts 21, respectively, which are used for fastening the oilpan 22 to the crankcase 1. The sidewalls 7 of the crankcase 1 are connected by omega-shaped crosspieces 23 forming part of the oilpan 22 in such a manner as to achieve maximum torsional rigidity, by arranging the additional bolts 20 in the main bearing walls 5 as far away from the outer walls as possible, in addition to the normally provided outer bolts 21, for fastening the oilpan 22 in place. Bolts 20 and 21 are accessible from below by the provision of pockets 24 in the oilpan 22, and by the provision of recesses 26 in the reinforced sidewalls 25 of the oilpan 22.

Triangular connecting elements 27 are provided adjacent the flanges 23' of the omega-shaped crosspieces 23 and are located in the same plane and of equal thickness as the flange 23'. Elements 27 join the reinforced sidewalls 25, and provide for openings 28 for the oil. The bottom 29 of the oilpan 22 is subjected to relatively low mechanical loads and is therefore not reinforced.

I claim:

1. A crankcase for an internal combustion engine, comprising main crankshaft bearing walls and sidewalls, said bearing walls comprising main bearing seats and main lower bearing caps, said sidewalls extending below said caps, an oilpan having sidewalls connected by crosspieces in alignment with said main bearing walls, said crosspieces each having an omega-shaped cross-section opening toward the bottom and being integral with the oilpan sidewalls so as to be torsionally rigid, first bolts for connecting the oilpan to the crankcase sidewalls, pockets in said crosspieces spaced inwardly of said crankcase sidewalls for the reception of second bolts for further connecting the oilpan to said bearing walls.

2. The crankcase according to claim 1, wherein the crankcase has bottom sections confronting the oilpan, said sections having pockets into which said first and second bolts extend, first ribs interconnecting said pockets of said sections at a first area with said crankcase sidewalls at a second area, said first ribs also interconnecting said pockets of said sections with said bearing walls.

3. The crankcase according to claim 2, wherein second ribs orthogonal to a central axis of the crankshaft interconnect the main bearing seats with the crankcase sidewalls at a third area, and wherein the spacing between said first and second areas is about the same as the spacing between said second and third areas.

4. The crankcase according to claim 3, wherein the interconnection of said first ribs with said bearing walls define downwardly opening recesses on opposite sides of said central axis, and said recesses being located above said bearing caps, whereby deformations due to gas and mass forces from propagating toward the crankcase sidewalls are substantially avoided.

5. The crankcase according to claim 2, wherein the interconnection of said first ribs with said bearing walls define downardly opening recesses on opposite sides of the central axis of the crankshaft, and said recesses being located above said bearing caps, whereby deformations due to gas and mass forces from propagating toward the crankcase sidewalls are substantially avoided.

* * * * *

UNITED STATES PATENT AND TRADEMARK OFFICE

CERTIFICATE OF CORRECTION

PATENT NO. : 4,876,998

DATED : October 31, 1989

INVENTOR(S) : Peter Wünsche

It is certified that error appears in the above-identified patent and that said Letters Patent is hereby corrected as shown below:

In the title page, correct the name of the Assignee to read --AVL Gesellschaft Fur Verbrennungskraftmaschinen und Messtechnik MbH. Prof. Dr. Dr. h. c. Hans List--.

Signed and Sealed this

Fifteenth Day of January, 1991

*Attest:*

HARRY F. MANBECK, JR.

*Attesting Officer*

*Commissioner of Patents and Trademarks*